US009019258B2

(12) United States Patent
Enami

(10) Patent No.: US 9,019,258 B2
(45) Date of Patent: Apr. 28, 2015

(54) DISPLAY DEVICE, DISPLAY DRIVE METHOD AND ELECTRONIC APPARATUS

(71) Applicant: Japan Display West, Inc., Aichi-Ken (JP)

(72) Inventor: Kunio Enami, Aichi-Ken (JP)

(73) Assignee: Japan Display West Inc., Aichi-Ken (JP)

( * ) Notice: Subject to any disclaimer, the term of this patent is extended or adjusted under 35 U.S.C. 154(b) by 80 days.

(21) Appl. No.: 13/682,869

(22) Filed: Nov. 21, 2012

(65) Prior Publication Data

US 2013/0208023 A1 Aug. 15, 2013

(30) Foreign Application Priority Data

Feb. 10, 2012 (JP) ..... 2012-026898

(51) Int. Cl.
*G09G 3/00* (2006.01)
*G09G 3/36* (2006.01)

(52) U.S. Cl.
CPC ..... *G09G 3/001* (2013.01); *G09G 3/3614* (2013.01); *G09G 3/3648* (2013.01); *G09G 2320/0204* (2013.01); *G09G 2320/0247* (2013.01)
USPC ..... 345/213

(58) Field of Classification Search
CPC ..... G09G 3/361; G09G 3/367; G09G 3/364; G09G 3/368; G09G 3/3614; G09G 3/3648; G09G 3/3611
USPC ..... 345/204, 96, 209, 213, 89
See application file for complete search history.

(56) References Cited

U.S. PATENT DOCUMENTS

| | | | | |
|---|---|---|---|---|
| 6,353,435 | B2 * | 3/2002 | Kudo et al. | 345/204 |
| 8,159,437 | B2 * | 4/2012 | Goto et al. | 345/89 |
| 8,325,123 | B2 * | 12/2012 | Li et al. | 345/89 |
| 2005/0140633 | A1 * | 6/2005 | Kato | 345/96 |
| 2008/0001890 | A1 * | 1/2008 | Song et al. | 345/96 |
| 2011/0234561 | A1 * | 9/2011 | Tzeng et al. | 345/209 |
| 2012/0068994 | A1 * | 3/2012 | Li et al. | 345/213 |

FOREIGN PATENT DOCUMENTS

| | | |
|---|---|---|
| JP | 62-052535 | 3/1987 |
| JP | 2005-215317 A | 8/2005 |
| JP | 2009-300781 A | 12/2009 |

OTHER PUBLICATIONS

Japanese Office Action issued Feb. 24, 2015 for corresponding Japanese Application No. 2012-026898.

* cited by examiner

*Primary Examiner* — Dwayne Bost
*Assistant Examiner* — Chineyere Wills-Burns
(74) *Attorney, Agent, or Firm* — Rader, Fishman & Grauer PLLC

(57) ABSTRACT

Provided is a display device including a pixel array forming by arranging a plurality of pixels whose display grayscale are controlled according to a pixel signal written, a signal line drive unit that outputs a pixel signal, to a plurality of signal lines, with a polarity according to a polarity signal, a scan line drive unit that drives the plurality of signal lines and performs a writing of the pixel signal output to the signal line into the pixels, a polarity signal generation unit that generates the polarity signal instructing the polarity of the pixel signal to be reversed, and supplies the result to the signal line drive unit, and a frame cycle set unit that generates the vertical start pulse in such a manner that a period of the number of vertical clocks that is not a multiple of the N is one frame period.

8 Claims, 9 Drawing Sheets

DISPLAY DEVICE, DISPLAY DRIVE METHOD AND ELECTRONIC APPARATUS

BACKGROUND

The present disclosure relates to a display device, a display drive method, and an electronic apparatus that perform a line reversal drive.

A liquid crystal display device, as is publicly known, performs a so-called alternating current drive that reverses a polarity of a voltage to be applied with respect to a pixel.

However, a positive polarity pixel luminance and a negative polarity pixel luminance do not match each other, due to precision and production variations of an electric circuit, and because of this, a flicker resulting from an alternating current drive occurs.

Therefore, in the related art, the flicker that is visually recognized is reduced by increasing a spatial frequency of a positive and negative luminance difference using a drive system, such as a line reversal, or a dot reversal.

For example, the line reversal drive and the like are disclosed in Japanese Unexamined Patent Application Publication Nos. 2009-300781 and 2005-215317.

SUMMARY

Incidentally, in the line reversal drive, there is a request for the compatibility of flicker mitigation and electric power consumption reduction.

For example, the technology is disclosed in Japanese Unexamined Patent Application Publication Nos. 2009-300781 and 2005-215317, which attempts the flicker mitigation and the electric power consumption reduction by shifting a block border of the line reversal every frame in the line reversal drive. However, because of this, a comparatively complicated drive circuit element is made necessary.

It is desirable to realize the compatibility of the flicker mitigation and the electric power consumption reduction with an extremely simple circuit configuration in a line reversal drive.

According to an embodiment of the present disclosure, there is provided a display device including a pixel array formed by arranging a plurality of pixels whose display grayscales are controlled according to a pixel signal written, in the row direction and in the column direction, a signal line drive unit that outputs a pixel signal with respect to each pixel, to a plurality of signal lines arranged in the pixel array, with a polarity according to a polarity signal, every one line period defined by a vertical clock, a scan line drive unit that sequentially drives a plurality of scan lines arranged in the pixel array and performs a writing of the pixel signal output to the signal line into the pixels in each line, every vertical clock timing, during one frame period starting with the timing of a vertical start pulse, a polarity signal generation unit that generates the polarity signal instructing the polarity of the pixel signal to be reversed in an N line period cycle, when being asynchronous with the vertical start pulse, and supplies the result to the signal line drive unit, and a frame cycle set unit that generates the vertical start pulse in such a manner that a period of the number of vertical clocks that is not a multiple of the N is one frame period.

According to another embodiment of the present disclosure, there is provided an electronic apparatus including the display device like this.

According to still another embodiment of the present disclosure, there is provided a display drive method for use in a display device including a pixel array formed by arranging a plurality of pixels whose display grayscales are controlled according to a pixel signal written in the row direction and in the column direction, a signal line drive unit that outputs a pixel signal with respect to each pixel, to a plurality of signal lines arranged in the pixel array, with a polarity according to a polarity signal, every one line period defined by a vertical clock, and a scan line drive unit that sequentially drives a plurality of scan lines arranged in the pixel array and performs a writing of the pixel signal output to the signal line into the pixels in each line, every vertical clock timing, during one frame period starting with the timing of a vertical start pulse, the display drive method including generating the polarity signal instructing the polarity of the pixel signal to be reversed in an N line period cycle, when being asynchronous with the vertical start pulse, and supplying the result to the signal line drive unit; and generating the vertical start pulse in such a manner that a period of the number of vertical clocks that is not a multiple of the N is one frame period.

With the technology according to the embodiment of the present disclosure like this, the pixel signal from the signal line drive unit is reversed in polarity, in an N line period cycle, based on the polarity signal. In this case, the polarity signal is asynchronous with the vertical pulse. One frame period defined by the vertical start pulse is made to be the period of the number of vertical clocks that is not a multiple of N. Accordingly, the border of the polarity reversal unit that is made up of N lines is shifted in each frame.

Additionally, since one frame period is prevented from being a multiple of N, $N \geq 2$.

According to the embodiment of the present disclosure, since the polarity signal is asynchronous with the vertical start pulse and one frame is the period of the number of clocks that is not a multiple of N, the border of the polarity reversal unit formed in the N lines is shifted in each frame, even though complicated drive control is not particularly performed. Accordingly, there is an effect that the flicker mitigation and the electric power consumption may be realized with an extremely simple circuit configuration for which the complicated control is not necessary.

DETAILED DESCRIPTION OF EMBODIMENTS

Embodiments are described below in the following order.

1. Configuration of Display Device
2. Line Reversal Drive according to First Embodiment
3. Line Reversal Drive according to Second Embodiment
4. Modification Examples and Application Examples

1. CONFIGURATION OF DISPLAY DEVICE

Figure 1:
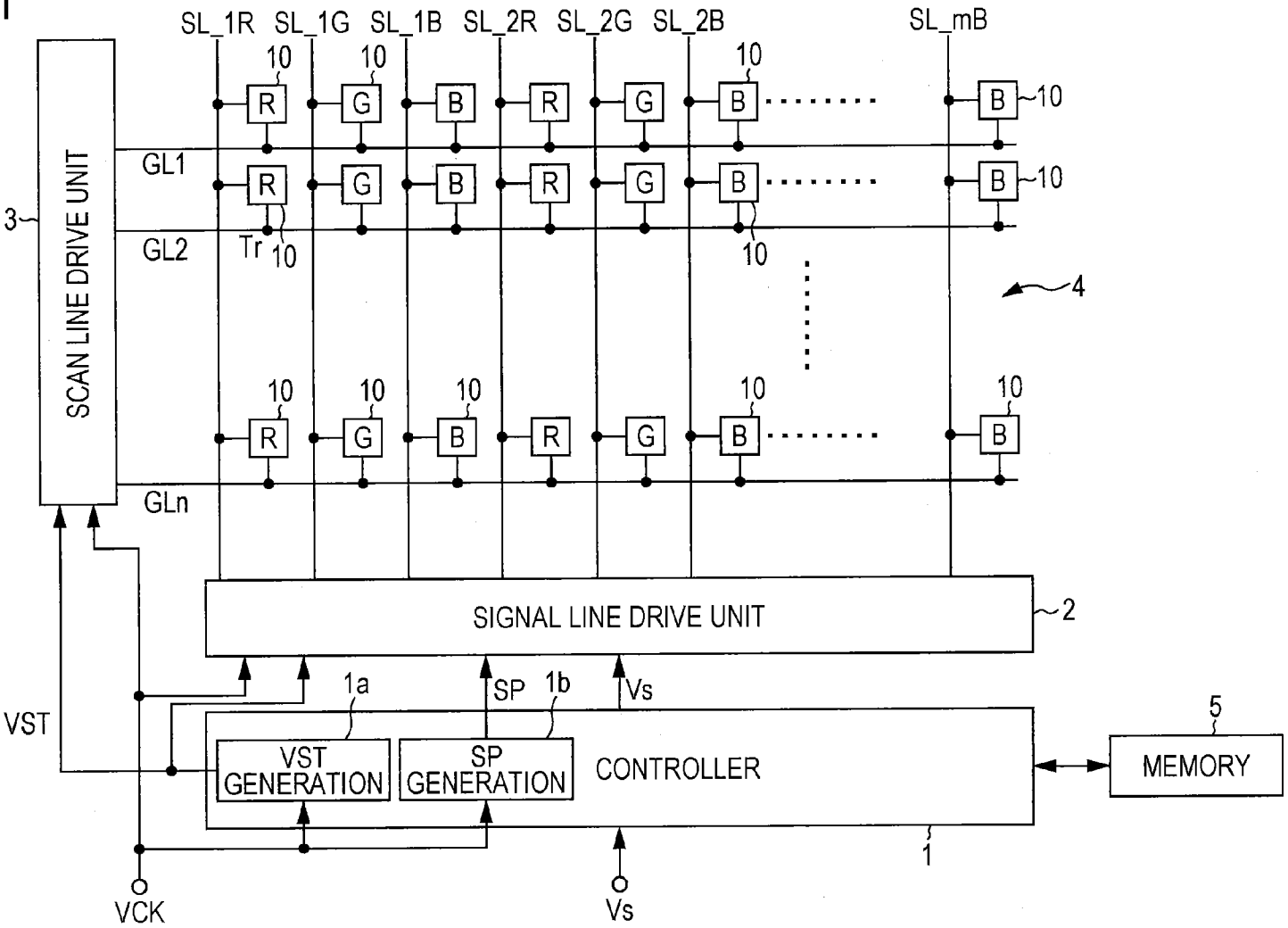
FIG. 1 is a view illustrating a configuration of a display device according to an embodiment of the present disclosure.
Figure 2:
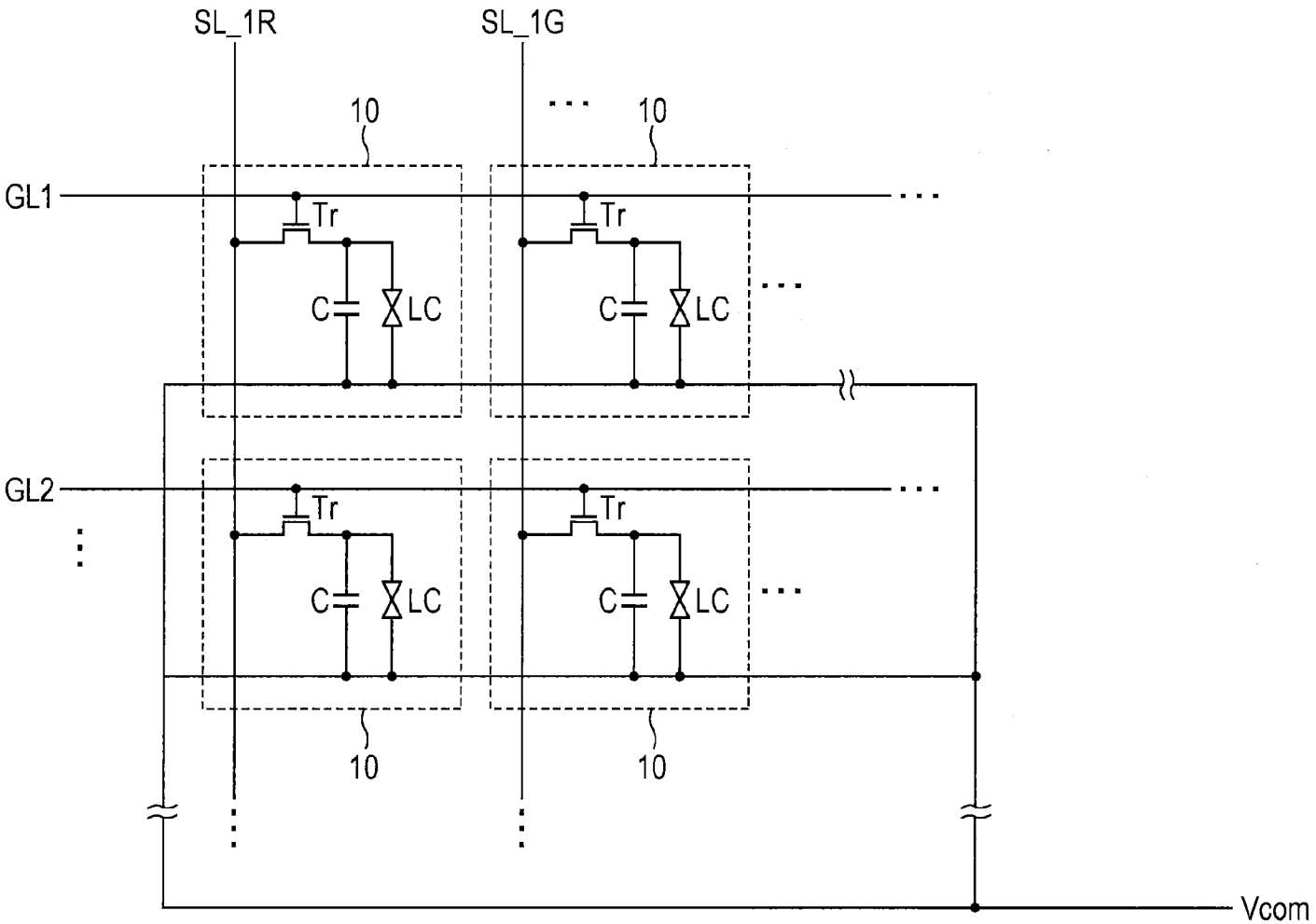
FIG. 2 is a view illustrating a configuration of pixels of the display device according to the embodiment.

A configuration of a liquid crystal display device as an embodiment is described referring to FIGS. 1 and 2. The liquid crystal display device is one example of an active-matrix type display device and has a controller 1, a signal line drive unit 2, a scan line drive unit 3, a pixel array 4, and a memory 5, as illustrated in FIG. 1.

The pixel array 4 is formed by arranging multiple pixels 10 whose display grayscales are controlled according to a pixel signal written, in the row direction and in the column direction, that is, in a matrix. The n×m pixels 10 are arranged to make up the matrix of n rows and m columns.

Symbols "R", "G", and "B" are given to the pixels 10 to indicate an R (red) pixel, a G (green) pixel, and a B (blue) pixel, respectively, in the drawing. R, G, and B color filters, although not illustrated in the drawing, are arranged to correspond to the R pixel, the G pixel, and the B pixel, respectively. A color display screen is configured by arranging the R pixels, the G pixels, and the B pixels, for example, as illustrated in the drawing.

Additionally, at this point, a three primary color pixel configuration is employed that includes the R pixels, the G pixels, and the B pixels, but there is a case where, for example, W (white) pixels are provided in addition to the R pixels, the G pixels, and the B pixels.

With respect to the pixel array 4, scan lines GL (GL1 to GLn) are arranged, corresponding to the pixels 10 in each line.

Furthermore, signal lines SL (SL_1R, SL_1G, SL_1B, SL_2 R and so forth to SL_mB) are arranged corresponding to the pixels 10 in each column.

The signal lines SL_1R and SL_2R and so forth supply the pixel signal with respect to a pixel column of the R pixels.

The signal lines SL_1G and SL_2G and so forth supply the pixel signal with respect to a pixel column of the G pixels.

The signal lines SL_1B and SL_2B and so forth supply the pixel signal with respect to a pixel column of the B pixels.

The scan lines GL are sequentially driven by the scan line drive unit 3.

The scan line drive unit 3 sequentially drives the scan lines GL1 to GLn every timing of a vertical clock VCK, during one frame period that starts with a timing of a vertical start pulse VST.

The pixel signal (a grayscale signal) is applied to the signal line SL by the signal line drive unit 2.

The signal line drive unit 2 outputs the pixel signal with respect to each pixel 10, with respect to the multiple signal lines SL arranged in the pixel array 4, with a polarity according to a polarity signal SP, every one line period defined by the vertical clock VCK.

The writing of the pixel signal outputted to the signal line SL in each pixel 10 is performed with the timing of a scan pulse given to a scan line.

An example of a configuration of the pixel 10 is illustrated in FIG. 2.

For a brief description, only the pixels 10, that correspond to intersections where the signal lines SL_1R and SL_1G and the scan lines GL1 and GL2 intersect, respectively, are illustrated in FIG. 2.

Each pixel 10 is configured to have, for example, a pixel transistor Tr (for example, an N channel TFT), made from a TFT (a thin film transistor), a liquid crystal cell LC, and a retention capacity C.

In the pixel transistor Tr, a gate electrode (a control terminal) is connected to the scan line GL, and one (an input terminal) of a source electrode and a drain electrode is connected to the signal line SL.

In the liquid crystal cell LC, a pixel electrode is connected to the other (an output terminal) of the source electrode and the drain electrode of the pixel transistor Tr, and an opposing electrode is connected to a Vcom line (a common electrode) whose illustration is omitted in FIG. 1.

Furthermore, in the retention capacity C, one electrode is connected to an output terminal of the pixel transistor Tr, and the other electrode is connected to the Vcom line.

In the pixel 10 like this, the pixel 10 to which the scan line GL is commonly wired, that is, the pixel 10 in a certain horizontal line may be selected by supplying a scan pulse signal to the scan line GL, and the writing of the pixel signal (a grayscale value) corresponding to each of the pixels 10 in the corresponding horizontal line may be possible by performing the supplying of a voltage to the pixel signal via the signal line SL in the corresponding selection state.

The necessary image display may be performed by sequentially in the horizontal line performing the selection of the horizontal line by the scan line GL and the writing of the pixel signal via the signal line SL, in this manner.

The controller 1 controls the signal line drive unit 2 and the scan line drive unit 3 in such a manner that these are synchronized with each other and operate, in order to perform a display in the pixel array 4, with regard to an image signal Vs supplied from the outside.

A vertical start pulse generation unit 1*a* that generates a vertical start pulse VCK, and a polarity signal generation unit 1*b* that generates a polarity signal SP are provided in the controller 1.

The vertical start pulse generation unit 1*a* generates a vertical start pulse VST using the vertical clock VCK, and supplies the vertical start pulse VST to the scan line drive unit 3 and the signal line drive unit 2. Additionally, the number of vertical clocks as one frame period is stored in the memory 5, and the vertical start pulse generation unit 1*a* counts the periods of the number of the stored vertical clocks, and generates the vertical start pulse VST. The vertical start pulse generation unit 1*a* sets a cycle of the vertical start pulse VST and thus sets a frame cycle in the liquid crystal display device of the present example.

Furthermore, the polarity signal generation unit 1*b* generates the polarity signal SP using the vertical clock VCK, and supplies the polarity signal SP to the signal line drive unit 2.

The generation of the vertical start pulse VST and the polarity signal SP is described below.

The scan line drive unit 3 outputs the scan pulse with respect to each of the scan lines GL1 to GLn, based on the vertical start pulse VST and the vertical clock VCK.

A shift register that sequentially transmits vertical start pulse VST with the timing of the vertical clock VCK is provided in the scan line drive unit 3. Accordingly, a sequential manipulation pulse is output to the scan lines GL1, GL2, and so forth to GLn, with the timing of the vertical start pulse as a starting point. Because of this, the pixels 10 in the first to n-th lines are in the selection state described above, every timing of the sequential vertical clock VCK, in the pixel array 4.

The signal line drive unit 2 outputs the pixel signal of one line unit to each of the signal lines SL_1R to SL_mB every timing of the vertical clock VCK, with the vertical start pulse VST as the starting point, with regard to the image signal Vs supplied from the controller 1.

In order to perform the line reversal drive at this point, the signal line drive unit 2 performs the polarity reversal on the pixel signal voltage outputted to the signal line SL according to the polarity signal SP.

By the operation like this, the sequential pixel signal is written into the pixel 10 in the first to n-th lines during one frame period, thereby setting the grayscale (the optical transmittance of a liquid crystal cell) of each pixel. Because of this, light from a backlight, not illustrated in the drawing, is controlled in terms of luminance in each pixel 10 and a color image display is performed via a color filter not illustrated.

2. LINE REVERSAL DRIVE ACCORDING TO FIRST EMBODIMENT

At this point, flicker mitigation and electric power consumption reduction when performing the line reversal drive are considered.

When considering the line reversal drive, it is preferable to reverse the signal polarity given to the pixel every frame, for example, in the unit of the number of the lines that is as small as one or two, in terms of the flicker mitigation.

Figure 3A:
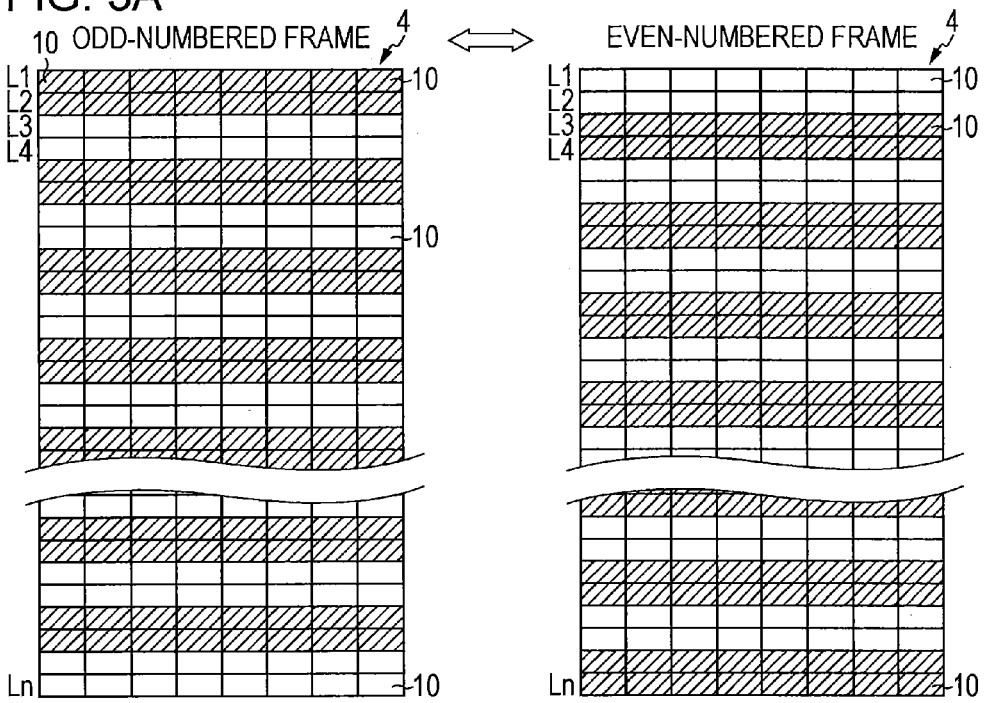
FIGS. 3A and 3B are views illustrating a case where N=4 in a general line reversal drive.

FIG. 3A is a view schematically illustrating the operation of the line reversal drive. FIG. 3A is a view illustrating the polarity of the pixel electrode to each pixel 10 in an odd-numbered frame and an even-numbered frame. In the drawing, one square is the pixel 10, the square that is given slanting lines is the pixel (the positive polarity pixel) in the positive polarity drive state, and the square without the slanting lines is the pixel (the negative polarity pixel) in the negative polarity drive state.

In FIG. 3A, for example, with regard to the pixels 10, as the pixel array 4, which are arranged in the row direction and in the column direction, that is, in a matrix, two lines of the pixels are regarded as one block of a polarity reversal unit.

And, for example, each pixel 10 in the block that is made up of the first line L1 and the second line L2 is driven with positive polarity in the odd-numbered frame and is driven with negative polarity in the even-numbered frame. Furthermore, each pixel 10 in the block that is made up of the third line L3 and the fourth line L4 is driven with negative polarity in the odd-numbered frame and is driven with positive polarity in the even-numbered frame.

In this manner, for example, the polarity reversal is performed in the block unit that is made up of two lines.

It is effective in terms of the flicker mitigation to decrease the number of the lines constituting the block and increase a spatial frequency of a positive and negative pixel luminance difference.

On the other hand, the increase in the spatial frequency is disadvantageous in terms of the electric power consumption.

The increase in the spatial frequency results in more frequent change in the value given to each pixel 10 in the pixel array 4, that is, in the pixel signal voltage to be written into the signal line SL arranged in the pixel array 4. In short, the frequent increase in the voltage of the signal line SL results in frequently performing charging and discharging on the signal line SL and thus the charge and discharge electric current brings about the increase in the electric current consumption.

Therefore, it is considered that the unit of the polarity reversal is increased and the spatial frequency is decreased.

Figure 3B:
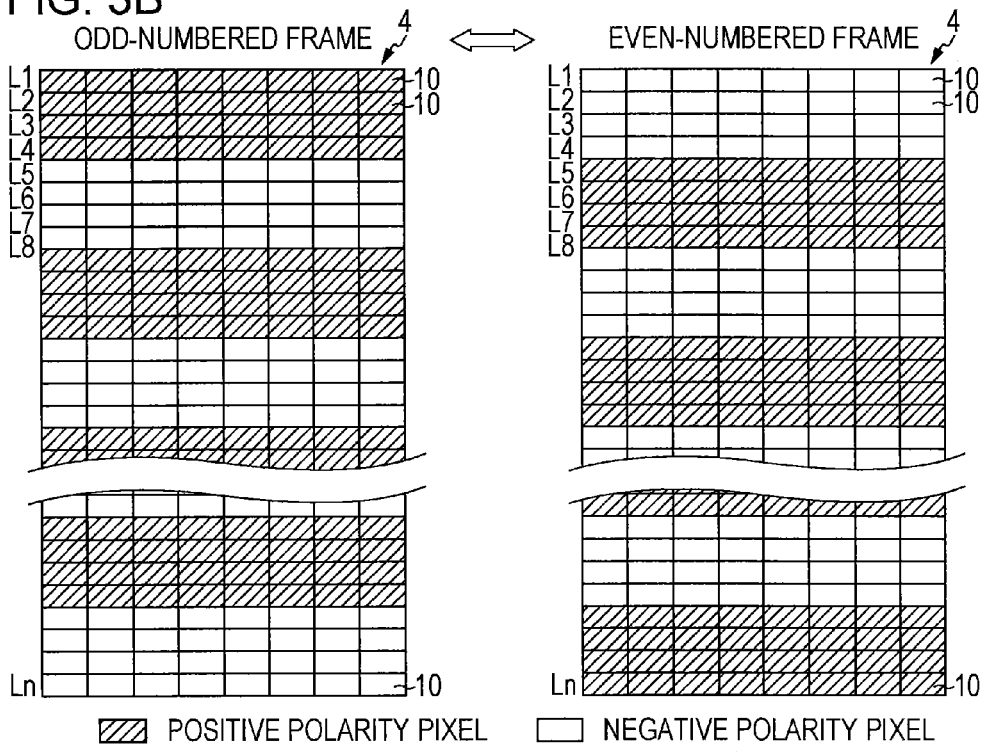

For example, as illustrated in FIG. 3B, with regard to the pixels 10 in the pixel array 4, four lines of the pixels 10 are defined as one block of the polarity reversal unit.

And, for example, each pixel 10 in the block that is made up of the first to fourth lines L1 to L4 is driven with positive polarity in the odd-numbered frame and is driven with negative polarity in the even-numbered frame. Furthermore, each pixel 10 in the block that is made up of the fifth to eighth lines L5 to L8 is driven with negative polarity in the odd-numbered frame and is driven with positive polarity in the even-numbered frame.

In this manner, for example, in terms of the electric current consumption reduction, it is effective to perform the polarity reversal in the block unit made up of the four lines and decrease the spatial frequency of the positive and negative pixel luminance difference.

However, the flicker is a phenomenon where the positive and negative polarity luminance difference that enables a block height of the polarity reversal unit to be the cycle of the spatial frequency is visually recognized, and therefore, when the block height (the number of the lines constituting the block in FIGS. 3A and 3B) is increased, the flicker is easy to visually recognize.

An appearance of the flicker is different depending on the screen size and the visual recognition distance, but if the number of the lines constituting one block is defined as N, the number is practical when N is up to 2.

When N=4, as illustrated in FIG. 3B, the flicker mitigation resulting from the line reversal drive is not much effective.

That is, when the number of the lines constituting the block is defined as N, if N is small, the flicker mitigation is effective, but the small number is disadvantageous in terms of the electric current consumption. On the other hand, if N is large, the large number is advantageous in terms of electric current consumption, but the effect of the flicker mitigation is small.

Therefore, according to the present embodiment, first, the line reversal drive is performed that results in sufficiently achieving the flicker mitigation effect, while reducing the electric current consumption by increasing N. Specifically, the border of the block where the polarity is reversed every N lines is shifted every frame and thus the flicker may be reduced to a practically sufficient degree while using the block made up of the N lines where N is large.

Moreover, the line reversal drive that is accompanied by the shift of the polarity reversal border is realized with the simple configuration illustrated in preceding FIG. 1.

Figure 4:
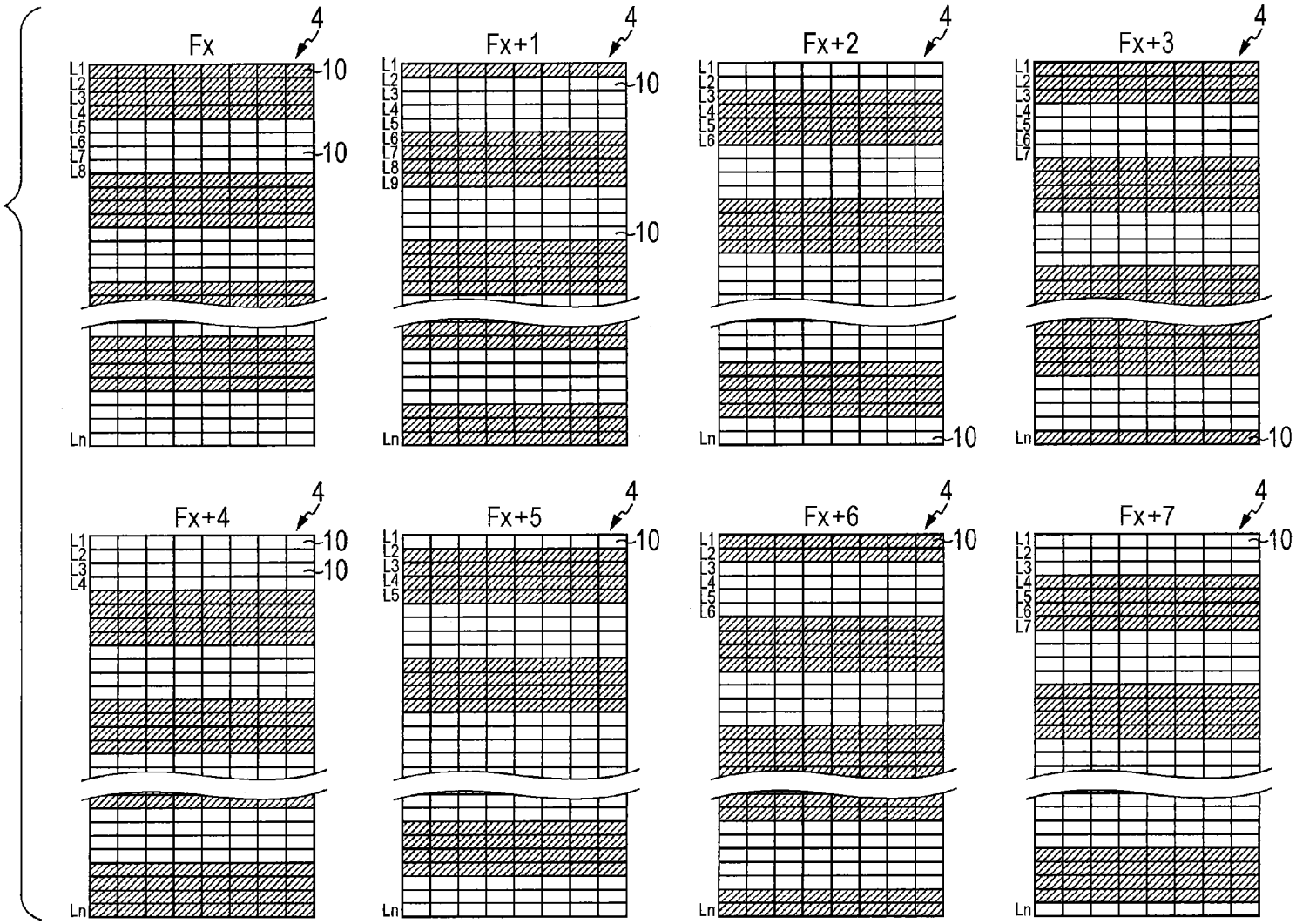
FIG. 4 is a view illustrating a line reversal drive according to a first embodiment.

First, in the first embodiment, an example of the line reversal drive that is accompanied by the shift of the polarity reversal border is described referring to FIG. 4.

For example, the drive state of each pixel 10 in the eight frames, namely, the frames Fx to Fx+7 is illustrated in FIG. 4 as in FIG. 3.

With regard to the pixels 10 in the pixel array 4, four lines of pixels are defined as one block of the polarity reversal unit, in FIG. 4 as in preceding FIG. 3B.

In the frame Fx, each pixel 10 in the block made up of the first to fourth lines L1 to L4 is driven with positive polarity and each pixel 10 in the block made up of the fifth to eighth lines L5 to L8 is driven with negative polarity. Each line that follows is also driven with positive polarity, negative polarity, positive polarity, negative polarity, and so forth, every four lines.

In the frame Fx+1, the line constituting the block is shifted. For example, the block made up of the first to fourth lines L1 to L4 in the frame Fx is the block made up of the second to fifth lines L2 to L5 in the frame Fx+1, and each pixel 10 in this block is driven with negative polarity. Each pixel 10 in the block made up of the sixth to ninth lines L6 to L9 that follow is driven with positive polarity.

That is, the border of the block is shifted one line and additionally in a state where the polarity reversal is performed.

While the border of the block is made to be shifted one line even in the frames Fx+2 to Fx+8 that follow, as illustrated in the drawing, the pixels 10 in each block are driven with the polarity being reversed.

The frame that follows the frame Fx+8 is the same as the frame Fx.

In the line reversal drive like this, even though the number N of the lines constituting the block as the polarity reversal unit is increased, for example, as in a case of four lines, the flicker mitigation may be realized and additionally the electric current consumption may be reduced due to decreasing the spatial frequency, by shifting the block border.

However, in order to realize the drive like this, a complicated circuit configuration is necessary as in Japanese Unexamined Patent Application Publication Nos. 2009-300781 and 2005-215317 that are above referred to.

That is, (a) a component that stores a reversal cycle (the number N of lines constituting a block) demanded, (b) a component that stores where a current drive frame is counting from the top, (c) a component that calculates where a current drive line is counting from the top, and (d) a component that calculates successively whether the polarity of a pixel signal is positive or negative, from the reversal cycle described above, the current drive frame, and the current drive line and that performs polarity reversal on a pixel signal, are at least necessary.

Particularly, the component (d) asks for a complicated circuit configuration that has a calculation function, in order to make variable, for example, the number of the lines that the block border is shifted at a time for each of various screen resolutions (the number of effective lines), a selectable line reversal cycle N and a frame, using general-purpose drive ICs.

In this present embodiment, the line reversal drive (hereinafter referred to as "line shift reversal drive" for the sake of description) that is performed while shifting the block border as illustrated in FIG. 4 is realized with he very simple configuration illustrated in FIG. 1.

Specifically, the polarity signal generation unit 1*b* of the controller 1 generates the polarity signal SP that instructs the polarity of the pixel signal to be reversed in an N line period cycle, at being asynchronous with the vertical start pulse VST, and supplies the result to the signal drive unit 2.

Furthermore, the vertical start pulse generation unit 1*a* of the controller 1 generates the vertical start pulse VST in such a manner that the period of the number of the vertical clocks VCK that is not a multiple of the number N of the lines constituting the block is one frame period.

Additionally, in order for one frame period not to be a multiple of N, necessarily N≥2.

Figure 5:
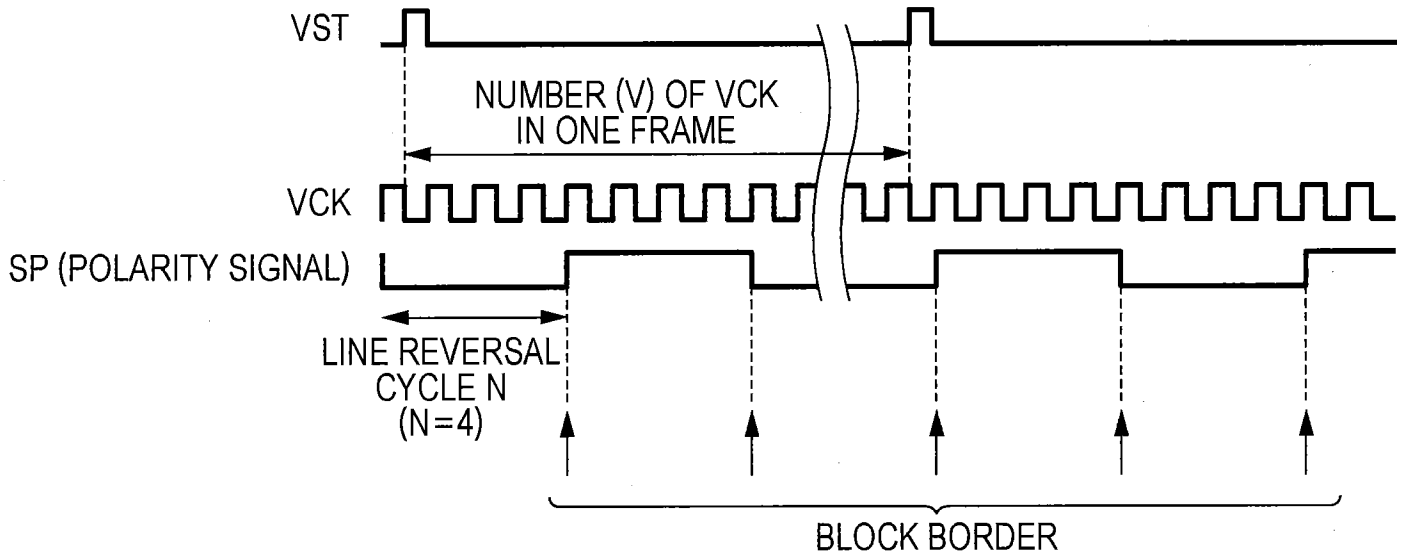
FIG. 5 is a view illustrating a relationship between a polarity reversal timing and a vertical start pulse according to the embodiment.

The description is provided referring to FIG. 5.

The vertical start pulse VST, the vertical clock VCK, and the polarity signal SP are illustrated in FIG. 5.

The vertical start pulse VST is a pulse that shows the front of one frame period, and is a pulse that shows a V VCK period when the number of the vertical clocks VCK during the one frame is defined as "V."

For example, when N=4 (four lines are defined as the reversal cycle) the polarity signal SP is a pulse that is reversed during the 4 VCK period.

For example, the signal line drive unit 2 outputs the positive pixel signal to the signal line SL during the line period during which the polarity signal SP is at a H level and outputs the negative pixel signal to the signal line SL during the line period during which the polarity signal SP is at a L level. That is, the signal line drive unit outputs the pixel signal that is to be output to each signal line SL during one line period, with the polarity assigned by the polar signal SP.

At this point, one frame cycle (V) is a period length of a sum of a vertical direction resolution (the number of the effective lines) of the display device and a vertical blanking period.

The border of the block of the polarity reversal unit is automatically shifted every frame, when the relationship between the frame cycle V and the line reversal cycle (N) is selected in such a manner that the frame cycle V is prevented from being a multiple of the line reversal cycle (N), and the polarity signal SP is made to be generated only by a count of the vertical clocks VCK, due to being asynchronous with the vertical start pulse VST.

The specifics are described as follows.

For the sake of description, it is assumed that the number of the lines is 400 in the pixel array 4. One frame cycle (V) is expressed as 400+vertical blanking periods.

Furthermore, it is assumed that N=4.

In this case, one frame cycle (V) is prevented from being a multiple of four. For example, the blanking period is defined as 7 VCK periods and then one frame cycle (V)=407 VCK periods.

In this case, the number "407" of the vertical clocks VCK, which is equivalent to one frame, is stored in the memory 5.

The vertical start pulse generation unit 1*a* counts the vertical clocks VCK that are input and generates the pulse with 400 counts. Accordingly, the vertical start pulse VST, which shows that one frame cycle (V)=407 VCK, is generated.

On the other hand, the polarity signal generation unit 1*b* divides the vertical clock VCK that is input, by four and generates the polarity signal SP with N=4. Moreover, with respect to a division output from the polarity signal generation unit 1*b*, the reset by the vertical start pulse VST is made not to be performed. Because of this, the polarity signal SP is asynchronous with the vertical start pulse VST.

Then, the drive is performed as illustrated in FIG. 4, in a certain frame Fx, and the block border is shifted one line in the frame Fx+1 that follows.

For example, in the frame Fx, after the last effective line Ln (L400), the polarity signal SP instructs the negative polarity drive to be performed during the line periods (the horizontal periods) L401 to L404 that are equivalent to the vertical blanking period not illustrated in the drawing, and the polarity signal SP instruct the positive polarity drive to be performed during the line periods (the horizontal periods) L405, L406, and L407 and the front line period L1 of the frame Fx+1 that follows. And during the line periods L2 to L5 of the frame Fx+1, the polarity signal SP instructs the negative polarity drive to be performed.

For this reason, the line shift reversal drive as illustrated in FIG. 4 is performed.

For example, with the performance as described above, the components such as (a), (b), (c), and (d) described above are not made necessary, and the line shift reversal drive may be performed with the very simple configuration as illustrated in FIG. 1.

Therefore, by increasing the number of the lines constituting the block of the polarity reversal unit, such as N=4, the visual recognition of the flicker may be reduced with the line shift, while realizing the electric current consumption reduction. The line shift reversal drive that may make the electric current consumption reduction and the flicker mitigation compatible like this may be realized with the extremely simple configuration. Because of this, it is possible to realize the reduction in the size of a drive-system circuit of the display device and the cost reduction, as well as to realize the electric current consumption reduction and the flicker mitigation.

Additionally, the relationship between the number N of the lines of the polarity reversal unit and the one frame cycle (V) is considered from various perspectives.

For example, in the case where the effective line number=400 and N=4 as described above, the vertical blanking period may be determined to be 9 VCK periods, 10 VCK periods, 11 VCK periods, 6 VCK periods or the like, and one frame period (V) may be determined to be 409 VCK periods, 410 VCK periods, 411 VCK periods, 406 periods or the like.

The prevention of the flame cycle V from being a multiple of the line reversal cycle (N) may be possible by a fine adjustment of the vertical blanking period in this manner.

In practice, the number of the effective lines (the vertical resolution) is considered for each liquid crystal display device, from various perspectives. Furthermore, when setting the number N of the lines of the polarity reversal unit, the number is not limited to 4. For example, it is considered that N=3, N=5, or N=6, or even that N is greater than 6.

From a configuration perspective, the vertical start pulse generation unit 1*a* refers to the number of the vertical clocks VCK of the one frame cycle stored in the memory 5, and generates the vertical start pulse VST by performing a vertical clock count on that number. Therefore, one frame cycle may be arbitrarily set by rewriting the number of the vertical clocks VCK of one frame cycle stored in the memory 5.

Furthermore, when the polarity signal generation unit 1*b* determines a configuration in which a division ratio is variable, with regard to the polarity signal SP, an arbitrary N may be set.

Therefore, even though a general-purpose drive control IC is used as the controller 1, the line shift reversal drive according to the present embodiment is easy to realize.

Furthermore, one frame cycle is determined in such a manner that one frame cycle (V) is prevented from being a multiple of the number N of the lines of the polarity reversal unit by adjusting the vertical blanking period, but conversely, the way may be employed where one frame cycle (V) is prevented from being a multiple of the number N of the lines of the polarity reversal unit by setting N. Therefore, for example, after setting the number of the specific effective lines and the vertical blanking period, the number N of the lines of the polarity reversal unit may be selected, and one frame cycle (V) may be prevented from being a multiple of the number N of the lines of the polarity reversal unit.

3. LINE REVERSAL DRIVE ACCORDING TO SECOND EMBODIMENT

Subsequently, as a second embodiment, an example of the line reversal drive that is accompanied by the shift of a polarity reversal border is described referring to FIG. 6. This is an example of the line reversal drive which combines vertical direction polarity reversals.

Figure 6:
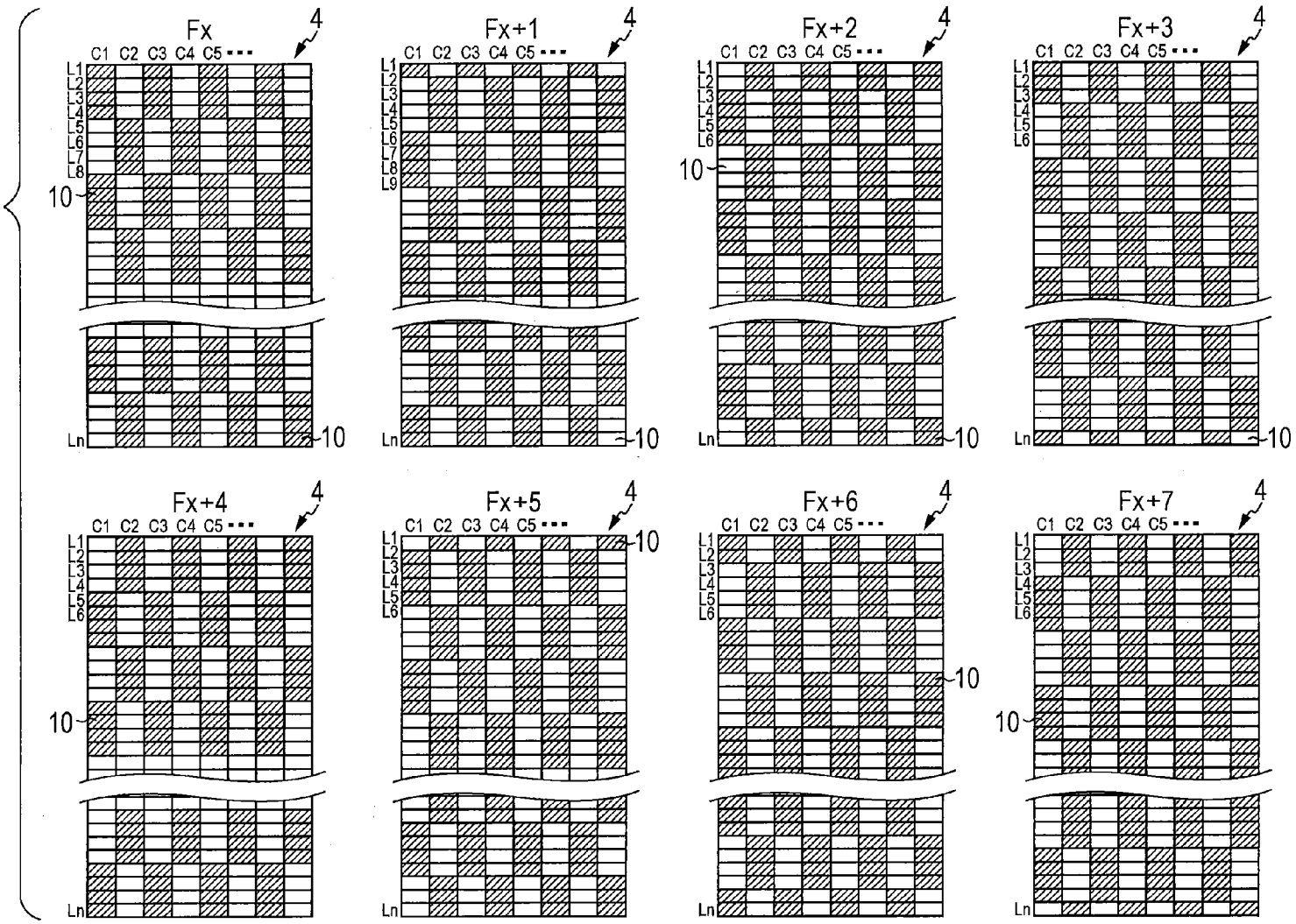
FIG. 6 is a view illustrating a line reversal drive according to a second embodiment.

For example, the drive state of each pixel 10 in the eight frames, namely, the frames Fx to Fx+7 is illustrated in FIG. 6 as in FIG. 4. The pixels 10 that are given slanting lines are the pixels that are driven with positive polarity, and the pixels 10 without the slanting lines is the pixels that are driven with negative polarity.

In the example in FIG. 6, with regard to the pixels 10 in the pixel array 4, four lines X one column of the pixels 10 are defined as one block of the polarity reversal unit. That is, the number N of the lines and the number M of the column that constitute the block are defined as 4, and 1, respectively.

In the frame Fx, each pixel 10 in the block in the first column C1, the block in the third column C3, the block in the fifth column C5 and so forth in the first and fourth lines L1 to L4 is driven with positive polarity, and similarly, each pixel 10 in the block in the second column C2, the block in the fourth column C4, and so forth in the first and fourth lines L1 to L4 is driven with negative polarity.

Each pixel 10 in the block in the first column C1, the block in the third column C3, the block in the fifth column C5 and so forth in the fifth and eighth lines L5 to L8 is driven with negative polarity, and similarly each pixel 10 in the block in the second column C2, the block in the fourth column C4, and so forth in the fifth and eighth lines L5 to L8 is driven with positive polarity.

Even each line that follows, is driven with positive polarity and is driven with negative polarity, in the unit of N×M blocks, as illustrated in the drawing.

In the frame Fx+1, the line constituting the block is shifted. For example, the block made up of the first to fourth lines L1 to L4 in the frame Fx is the block made up of the second to fifth lines L2 to L5 in the frame Fx+1.

In the frame Fx+1, for example, each pixel 10 in the block in the first column C1, the block in the third column C3, the block in the fifth column C5 and so forth in the second and fifth lines L2 to L5 is driven with negative polarity, and each pixel 10 in the block in the second column C2, the block in the fourth column C4, and so forth is driven with positive polarity.

Each pixel 10 in the block in the first column C1, the block in the third column C3, the block in the fifth column C5 and so forth in the sixth and ninth lines L6 to L9 is driven with positive polarity, and each pixel 10 in the block in the second column C2, the block in the fourth column C4, and so forth is driven with negative polarity.

Even each line that follows, is driven with positive polarity and is driven with negative polarity, in the unit of N×M blocks, as illustrated in the drawing.

That is, the column constituting the block is the same in the frame Fx+1, but the border of the line constituting the block is shifted one line and is in a state where the polarity reversal drive is performed.

While the border line of the block is made to be shifted one line even in the frames Fx+2 to Fx+8 that follow, as illustrated in the drawing, the pixels 10 in each block are driven with the polarity being reversed, as illustrated in the drawing.

The frame that follows the frame Fx+8 is the same as the frame Fx.

In this manner, even in the line reversal drive, which combines the vertical direction reversals, despite the fact that the number N of the lines constituting the block as the polarity reversal unit is increased, for example, as in a case of four lines, the flicker mitigation may be realized by shifting the block border. And the electric current consumption may reduced by the decrease in the spatial frequency.

The realization of the line reversal drive that combines the vertical direction reversals may be possible with the simple configuration as illustrated in FIG. 1.

When M=1 as described above, the signal line drive unit 2 reverses the pixel signal given to each signal line SL, every column.

For example, during the H level period during which the polarity signal SP assigns the positive polarity, the pixel signal is output in such a manner that the positive polarity pixel signal is output with respect to the signal line SL_1R, the negative polarity pixel signal is output with respect to the signal line SL_1G, the positive polarity pixel signal is output with respect to the signal line SL_1B, the negative polarity pixel signal is output with respect to the signal line SL_2R, and so forth, the positive polarity pixel signal is output with respect to the signal line SL_m-1B, and the negative polarity pixel signal is output with respect to the signal line SL_mB.

On the other hand, during the L level period that the polarity signal SP assigns the negative polarity, the pixel signal is output in such a manner that the negative polarity pixel signal is output with respect to the signal line SL_1R, the positive polarity pixel signal is output with respect to the signal line SL_1G, the negative polarity pixel signal is output with respect to the signal line SL_1B, the positive polarity pixel signal is output with respect to the signal line SL_2R, and so forth, the negative polarity pixel signal is output with respect to the signal line SL_m-1B, and the positive polarity pixel signal is output with respect to the signal line SL_mB.

That is, the signal line drive unit sets the polarity of the pixel signal, which is to be supplied to each of the signal lines SL_1R to SL_mB, to be a polarity that is reversed every M columns (M=1 means one column) during one line period. During each line period, the pixel signal is output to each of the signal lines SL_1R to SL_mB, by reversing the polarity that is set, according to the polarity signal SP.

When the polarity signal SP is, for example, a signal that is a result of dividing the vertical clock VCK by four, according to N=4, as described as the first embodiment, the signal line drive unit 2 outputs the pixel signal with respect to each of the signal lines SL_1R to SL_mB, with the polarity described above, and thus, for example, the drive as in the frame Fx in FIG. 6, is performed in a certain frame.

Moreover, the border line of the block of the polarity reversal unit is automatically shifted every frame as illustrated in FIG. 6, when the relationship between the frame cycle V and the line reversal cycle (N) is selected in such a manner that the frame cycle V is prevented from being a multiple of the line reversal cycle (N) and the polarity signal SP is made to be generated only by a count of the vertical clocks VCK, due to being asynchronous with the vertical start pulse VST.

That is, even in the line reversal drive that combines the vertical direction reversals, the shift of the block border line, which makes the flicker mitigation and the electric current consumption possible, may be realized with the very simple configuration.

Additionally, the number M of the columns constituting the block is 1 in the example in FIG. 6, but an example, in which the number of the columns constituting the block is different like M=2, M=3, and so forth, is naturally considered.

What differentiates this from the first embodiment is that the signal line drive unit 2 only sets the polarity of the pixel signal that is to be output to each signal line SL, in the unit of the number M of the columns constituting the block, and because the complicated calculation circuit configuration is not necessary in this setting, the simple circuit configuration may be realized, even in the second embodiment, without having to set the number M of the columns.

4. MODIFICATION EXAMPLES AND APPLICATION EXAMPLES

The embodiment is described above, but the configuration of the liquid crystal display device described above is one example and the configuration of the pixel 10 is also one example. The technology in the present disclosure may be applied to the device configuration that is used in various liquid crystal display devices.

Furthermore, the present disclosure may be broadly applied to the display device performing an alternating current drive with respect to the pixel.

Next, an application example of the liquid crystal display device that is described as the embodiment is described referring to FIGS. 7 to 9. The liquid crystal display device according to the embodiment may be applied to an electronic apparatus in all the fields which displays an image signal input from the outside or an image signal generated inside, as an image or a screen image, such as a television apparatus, a digital camera, a notebook-type personal computer, a portable terminal apparatus such as a portable telephone, or a video camera.

Application Example 1

Figure 7A:
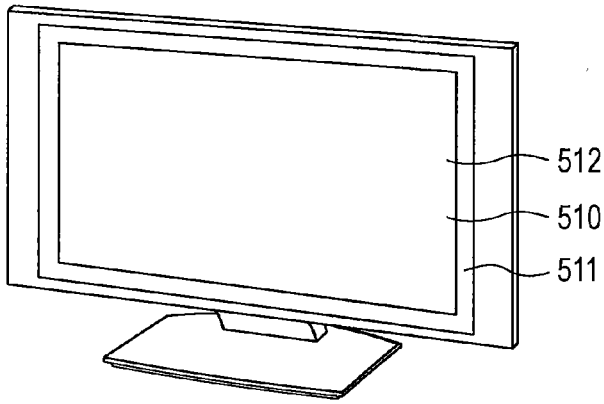
FIGS. 7A to 7C are views illustrating an application example of an electronic apparatus according to the embodiment.
Figure 7B:
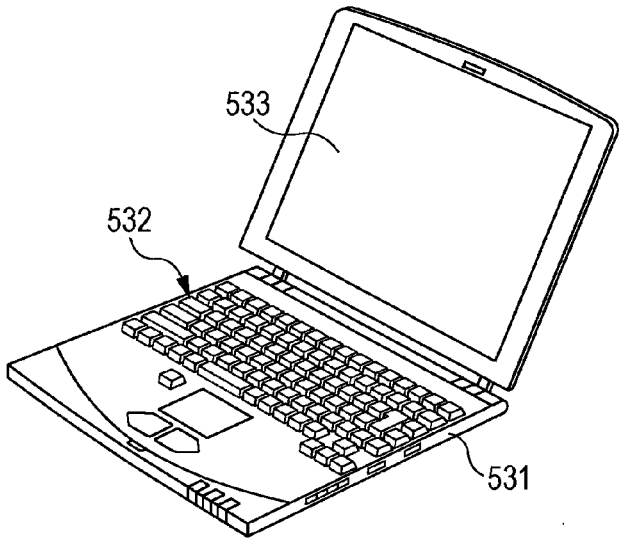
Figure 7C:
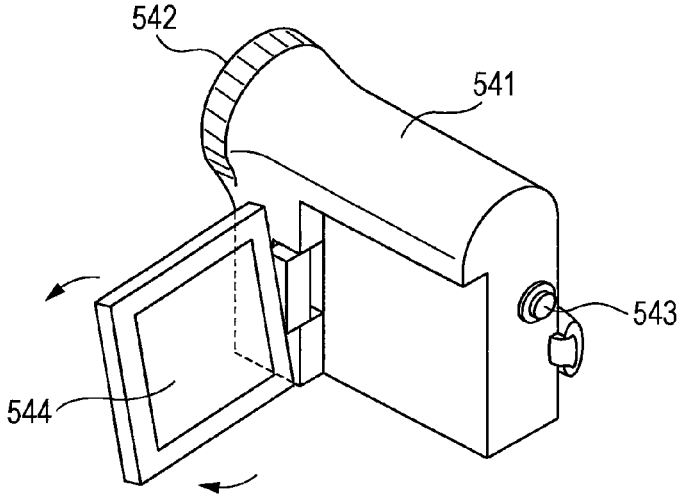

An external appearance of the television apparatus to which the liquid crystal display device according to the embodiment is applied is illustrated in FIG. 7A. The television apparatus has, for example, an image display screen unit 510 including a front panel 511 and a filter glass 512, and the image display screen unit 510 is configured to have the liquid crystal display device according to the embodiment described above.

Application Example 2

An external appearance of the notebook-type personal computer to which the liquid crystal display device according to the embodiment described above is applied is illustrated in FIG. 7B. The notebook-type personal computer has, for example, a main body 531, a keyboard 532 for the input manipulation of letters and others, and a display unit 533 displaying an image, and the display unit 533 is configured to have the liquid crystal display device according to the embodiment described above.

Application Example 3

An external appearance of the video camera to which the liquid crystal display device according to the embodiment described above is applied is illustrated in FIG. 7C. The video camera has, for example, a main body 541, an object-imaging lens 542 provided in front of the main body 541, an imaging start/stop switch 543 and a display unit 544, and the display unit 544 is configured to have the liquid crystal display device according to the embodiment described above.

Application Example 4

Figure 8A:
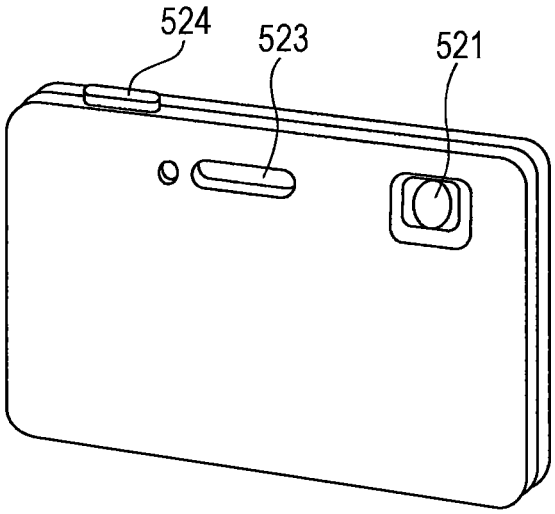
FIGS. 8A and 8B are views illustrating an application example of an electronic apparatus according to the embodiment.
Figure 8B:
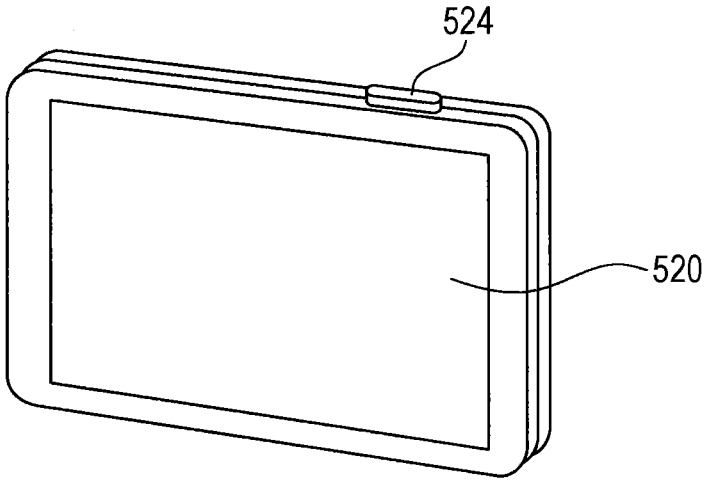

An external appearance of the digital camera to which the liquid crystal display device according to the embodiment described above is applied is illustrated in FIGS. 8A and 8B. A front-side external appearance and a back-side external appearance are illustrated in FIGS. 8A and 8B, respectively.

The digital camera has, for example, a display unit 520 with a touch panel, an imaging lens 521, flash light-emitting unit 523, a shutter button 524, and others, and the display unit 520 is configured to have the liquid crystal display device according to the embodiment described above.

Application Example 5

Figure 9A:
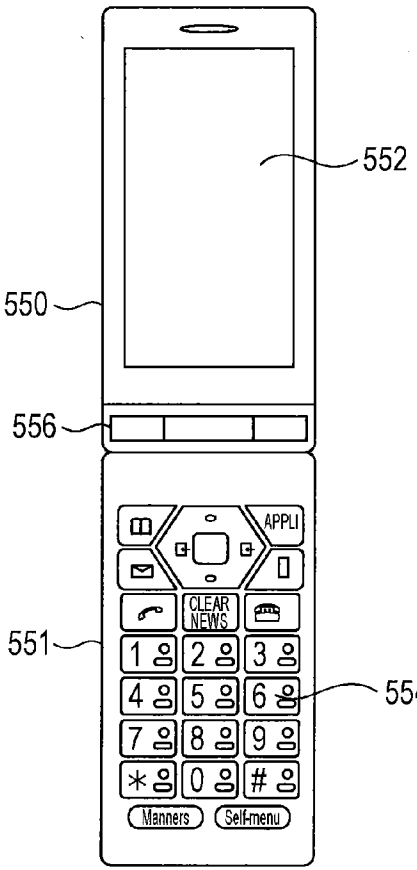
FIGS. 9A to 9E are views illustrating an application example of an electronic apparatus according to the embodiment.
Figure 9B:
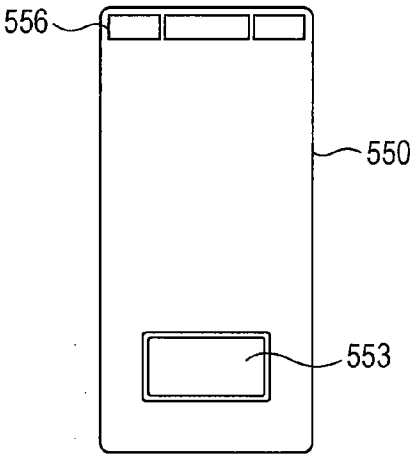
Figure 9C:
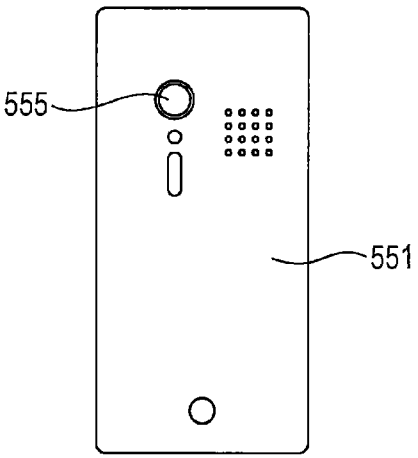
Figure 9D:
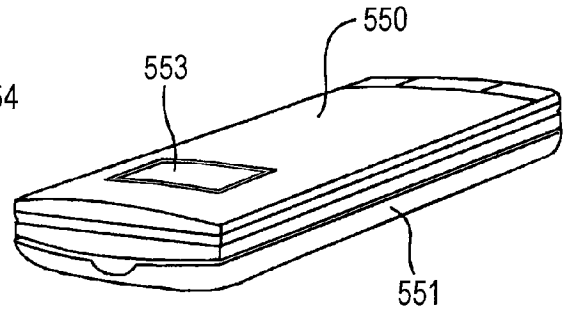
Figure 9E:
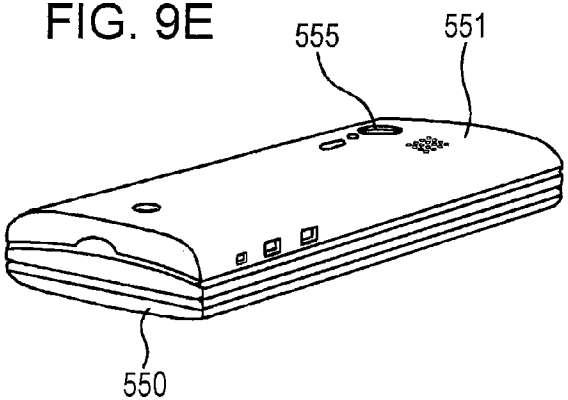

An external appearance of the cellular telephone to which the liquid crystal display device according to the embodiment described above is applied is illustrated in FIGS. 9A to 9E. FIG. 9A is a view illustrating a manipulation side and a display side of the portable telephone, which are viewed when the portable telephone is unfolded, and FIGS. 9B and 9C are views illustrating a top side and a bottom side, which are viewed when the portable telephone is folded, respectively. FIGS. 9D and 9E are perspective views of the top side and the bottom side that are viewed when the portable telephone is folded.

The top case 550 and the bottom case 551 of the portable telephone are connected to each other with a connection unit (a hinge unit) 556 and the portable telephone has, for example, a display 552, a sub display 553, a key manipulation unit 554, a camera 555, and others. The display 552 or the sub display 553 is configured to have the liquid crystal display device according to the embodiment described above.

Furthermore, the present technology may employ a configuration as follows.

(1) A display device including a pixel array formed by arranging a plurality of pixels whose display grayscale are controlled according to a pixel signal written, in the row direction and in the column direction, a signal line drive unit that outputs a pixel signal with respect to each pixel, to a plurality of signal lines arranged in the pixel array, with a polarity according to a polarity signal, every one line period defined by a vertical clock, a scan line drive unit that sequentially drives the plurality of signal lines arranged in the pixel array and performs a writing of the pixel signal output to the signal line into the pixels in each line, every vertical clock timing, during one frame period starting with a timing of a vertical start pulse, a polarity signal generation unit that generates the polarity signal instructing the polarity of the pixel signal to be reversed in an N line period cycle, at being asynchronous with the vertical start pulse, and supplies the result to the signal line drive unit, and a frame cycle set unit that generates the vertical start pulse in such a manner that a period of the number of vertical clocks that is not a multiple of the N is one frame period.

(2) The display device according to (1), wherein the frame cycle set generates the vertical start pulse in such a manner that the number of the vertical clocks during one frame is not a multiple of the N, with a selection of the number of the vertical clocks during a vertical blanking period, during one frame period that is made up of the effective line period and the vertical blanking period.

(3) The display device according to (1) or (2), further including a storage unit that stores the number of vertical clocks, as one frame period, that is not a multiple of the N, wherein the frame cycle set unit generates the vertical start pulse of which one cycle is the number of the vertical clocks stored in the storage unit.

(4) The display device according to (1) to (3), wherein the polarity signal generation unit generates the polarity signal by dividing the vertical clock, and the corresponding polarity signal is not reset by the vertical start pulse, thereby being asynchronous with the vertical start pulse.

(5) The display device according to (1) to (4), wherein the signal line drive unit that outputs the pixel signal to be output to each signal line during one line period, with the polarity assigned by the polarity signal.

(6) The display device according to (1) to (4), wherein the signal line drive unit sets a polarity of the pixel signal, which is to be output to each signal line during one line period, to be a polarity that is reversed in the unit of M columns, and outputs the polarity to each of the signal signals, by reversing the polarity that is set, according to the polarity signal.

The present disclosure contains subject matter related to that disclosed in Japanese Priority Patent Application JP 2012-026898 filed in the Japan Patent Office on Feb. 10, 2012, the entire contents of which are hereby incorporated by reference.

It should be understood by those skilled in the art that various modifications, combinations, sub-combinations and alterations may occur depending on design requirements and, other factors insofar as they are within the scope of the appended claims or the equivalents thereof.

What is claimed is:

1. A display device comprising:

a pixel array formed by arranging a plurality of pixels whose display grayscales are controlled according to a pixel signal written, in the row direction and in the column direction;

a signal line drive unit that outputs a pixel signal with respect to each pixel, to a plurality of signal lines arranged in the pixel array, with a polarity according to a polarity signal, every one line period defined by a vertical clock;

a scan line drive unit that sequentially drives a plurality of scan lines arranged in the pixel array and performs a writing of the pixel signal output to the signal line into the pixels in each line, every vertical clock timing, during one frame period starting with a timing of a vertical start pulse;

a polarity signal generation unit that generates the polarity signal, the polarity signal instructing the polarity of the pixel signal to be reversed in an N line period cycle and being asynchronous with respect to the vertical start pulse, and supplies the result to the signal line drive unit; and a frame cycle set unit that generates the vertical start pulse in such a manner that a period of the number of vertical clocks that is not a multiple of the N is one frame period, where N is a positive integer.

2. The display device according to claim 1, wherein the frame cycle set unit generates the vertical start pulse in such a manner that the number of the vertical clocks during one frame is not a multiple of the N, with a selection of the number of the vertical clocks during a vertical blanking period, during one frame period that is made up of the effective line period and the vertical blanking period.

3. The display device according to claim 1, further comprising:

a storage unit that stores the number of vertical clocks, as one frame period, that is not a multiple of the N, wherein the frame cycle set unit generates the vertical start pulse of which one cycle is the number of the vertical clocks stored in the storage unit.

4. The display device according to claim 1, wherein the polarity signal generation unit generates the polarity signal by dividing the vertical clock, and the corresponding polarity signal is not reset by the vertical start pulse, thereby being asynchronous with the vertical start pulse.

5. The display device according to claim 1, wherein the signal line drive unit that outputs the pixel signal to be output to each signal line during one line period, with a polarity assigned by the polarity signal.

6. The display device according to claim 1, wherein the signal line drive unit sets a polarity of the pixel signal, which is to be output to each signal line during one line period, to be a polarity that is reversed in the unit of M columns, and outputs the pixel signal to each of the signal lines, by reversing the polarity that is set, according to the polarity signal.

7. A display drive method for use in a display device including, a pixel array formed by arranging a plurality of pixels whose display grayscales are controlled according to a pixel signal written, in the row direction and in the column direction, a signal line drive unit that outputs a pixel signal with respect to each pixel, to a plurality of signal lines arranged in the pixel array, with a polarity according to a polarity signal, every one line period defined by a vertical clock, and a scan line drive unit that sequentially drives a plurality of scan lines arranged in the pixel array and performs a writing of the pixel signal output to the signal line into the pixels in each line, every vertical clock timing, during one frame period starting with a timing of a vertical start pulse, the display drive method comprising:

generating the polarity signal, the polarity signal instructing the polarity of the pixel signal to be reversed in an N line period cycle and being asynchronous with respect to the vertical start pulse, and supplying the result to the signal line drive unit; and generating the vertical start pulse in such a manner that a period of the number of vertical clocks that is not a multiple of the N is one frame period, where N is a positive integer.

8. An electronic apparatus comprising:

a display device including, a pixel array forming by arranging a plurality of pixels whose display grayscales are controlled according to a pixel signal written, in the row direction and in the column direction, a signal line drive unit that outputs a pixel signal with respect to each pixel, to a plurality of signal lines arranged in the pixel array, with a polarity according to a polarity signal, every one line period defined by a vertical clock, a scan line drive unit that sequentially drives a plurality of scan lines arranged in the pixel array and performs a writing of the pixel signal output to the signal line into the pixels in each line, every vertical clock timing, during one frame period starting with a timing of a vertical start pulse, a polarity signal generation unit that generates the polarity signal, the polarity signal instructing the polarity of the pixel signal to be reversed in an N line period cycle and being asynchronous with respect to the vertical start pulse, and supplies the result to the signal line drive unit, and a frame cycle set unit that generates the vertical start pulse in such a manner that a period of the number of vertical clocks that is not a multiple of the N is one frame period, where N is a positive integer.

* * * * *